US005127799A

United States Patent [19]

Berry

[11] Patent Number: 5,127,799

[45] Date of Patent: Jul. 7, 1992

[54] INTERSTAGE COUPLING SEAL AND METHOD OF ASSEMBLING A GAS TURBINE ENGINE

[75] Inventor: Brian S. Berry, Tempe, Ariz.

[73] Assignee: Allied-Signal Inc., Morris Township, Morris County, N.J.

[21] Appl. No.: 628,297

[22] Filed: Dec. 17, 1990

[51] Int. Cl.[5] ..... F04D 29/08

[52] U.S. Cl. ..... 415/170.1; 415/173.7; 415/174.2; 277/236

[58] Field of Search ..... 415/170.1, 173.7, 174.2, 415/174.3, 229, 230, 231; 277/236

[56] References Cited

U.S. PATENT DOCUMENTS

| | | | |
|---|---|---|---|
| 2,008,520 | 7/1935 | Soderberg | 415/173.7 |
| 2,309,878 | 2/1943 | Wiberg . | |
| 3,094,309 | 6/1963 | Hull, Jr. et al. . | |
| 3,159,379 | 12/1964 | Auger . | |
| 3,295,825 | 1/1967 | Hall, Jr. | 415/173.7 |
| 3,733,146 | 5/1973 | Smith et al. . | |
| 3,841,792 | 10/1974 | Amos . | |
| 3,869,222 | 3/1975 | Rahnke et al. | 415/138 |
| 3,893,786 | 7/1975 | Rahnke et al. | 415/138 |
| 4,199,151 | 4/1980 | Bartos | 277/236 |
| 4,337,016 | 6/1982 | Chaplin | 415/138 |
| 4,526,508 | 7/1985 | Antonellis et al. . | |
| 4,869,516 | 9/1989 | Udagawa et al. | 277/236 |

*Primary Examiner*—John T. Kwon

*Attorney, Agent, or Firm*—Jerry J. Holden; James W. McFarland; Robert A. Walsh

[57] ABSTRACT

An interstage coupling seal for sealing between mating sections of an interstage, torque transmitting, coupling member is provided, as is a method for assembling a gas turbine engine having a plurality of rotor disks. The seal is comprised of annular ring having a plurality of radially extending plates. A first portion of these plates form a means for attaching to the interior surface of one of the mating sections of the coupling member. A second portion of the plates moves into radially sealing contact between the coupling members when its mating sections are interengaged. The method for assembling a gas turbine engine includes the steps of separately preassembling each of the rotor disks. During preassembly, the mating sections of the coupling members are attached to the shaft portions of the rotor disks. Then, the coupling seal is inserted and attached to the interior of the one of the mating sections. Thus, the appropriate coupling seal is attached to the appropriate rotor disk before the engine undergoes final assembly, thereby eliminating misassembly errors common with the prior art ring seals.

5 Claims, 3 Drawing Sheets

INTERSTAGE COUPLING SEAL AND METHOD OF ASSEMBLING A GAS TURBINE ENGINE

TECHNICAL FIELD

This invention relates generally to a seal for an interstage coupling comprised of opposing mating sections and a method for assembling a gas turbine engine having such seals. More specifically, the invention relates to an interstage coupling seal comprising a plurality of radially extending members having a first portion which radially seals the coupling when axially compressed between the coupling's mating sections and having a second portion which snap fits to the interior surface of one of the mating sections, and a method which includes attaching the coupling seal to one of the mating sections during the preassembly of the gas turbine engine's components.

BACKGROUND OF THE INVENTION

A gas turbine engine is comprised of an inlet, a compressor, a combustor, a turbine, and an exhaust. An annular flow path extends axially from the inlet through the exhaust and is defined by a stator assembly circumscribing a rotor assembly. Air entering through the inlet is pressurized in the compressor, then mixed with fuel and ignited in the combustor resulting in a hot, high pressure gas. The hot gas is expanded across the turbine to produce useful work. A portion of this work is used to drive the compressor and the remainder is used to propel an aircraft with thrust or to drive a free turbine.

The stator assembly has an outer case which contains the working gas and has arrays of stator vanes. Each array of stator vanes extends radially from an outer endwall to an inner endwall crossing the flow path of the working gas upstream of an associated array of rotor blades. The stator vanes direct the working gas into the arrays of rotor blades at angles which optimize the performance of the engine. The stator assembly includes a front and rear bearing support for rotatably supporting the rotor assembly.

The rotor assembly extends axially through the engine and transfers work from the turbine to the compressor. The rotor assembly is comprised of compressor rotor disks and turbine rotor disks. The compressor and turbine rotor disks each have a shaft portion extending axially from the center of each disk. All the shafts are interconnected in series by interstage couplings. Each of the shafts has a hollow center defining a bore extending axially through the rotor assembly. Through this bore cooling air can be passed from the compressor to the turbine. A tie shaft extends axially through the bore. The compressor and turbine disks are mounted on the tie shaft forming a single rotating unit called a spool. The spool is supported by the front and rear bearing supports mounted to the stator assembly. The compressor and turbine rotor disks each have an array of rotor blades radially extending from the disks into the flow path. In the compressor, the rotor blades are angled with respect to the approaching air so as to inject energy and pressurize the air, and in the turbine, the rotor blades are angled with respect to the approaching flow of hot gas to extract work from the gas and convert this work into mechanical energy for driving the turbine disks, shafts, and compressor disks about their axis of rotation.

The interstage coupling is a torque transmitting coupling which may generally be described as having a plurality of radial splines on opposing mating sections that interengage to connect the sections. A problem with these couplings is that the air within the bore radially leaks through the gaps between the meshing radial splines. One approach to reducing the leakage through these gaps is to place a ring seal, as shown in FIG. 2*b*, between the mating sections of the coupling so that when the mating sections are pressed together, the axial compression forces the seal ring into a sealing engagement with the underside of the radial splines.

Problems with these ring seals have arisen during the assembly of the gas turbine engine. It is common practice, for gas turbine manufacturers, to preassemble the individual components of the gas turbine engine, (e.g. compressor disks, turbine disks, including attaching the mating sections of the interstage couplings to their respective components), separately from each other and then bring all the components together for the final assembly. During the final assembly, the components are mounted vertically. Each component, one by one, is slid over the tie shaft and their respective coupling sections are interengaged. It is during this stacking of the components that the ring seal is manually inserted between mating sections. Because the ring seal is not attached to its mating section prior to final assembly, it is not uncommon for the seal to be inadvertently left out, or for a seal with an improper number of cooling holes to be inserted, or for a seal to be inserted between a set of mating sections where none is required. Any of these assembly errors may result in one or more components of the gas turbine engine not receiving the proper cooling flow which will eventually cause damage to the component(s).

Accordingly, a need exists for an interstage coupling seal and method that can be fixedly mounted to a section of a the coupling prior to the final assembly of the gas turbine engine.

SUMMARY OF THE INVENTION

An object of the present invention is to provide an interstage coupling seal that can be fixedly mounted to a section of the coupling member prior to the final assembly of the gas turbine engine.

Another object of the subject invention is to provide a method for assembling a gas turbine engine that reduces the misassembly of interstage coupling seals.

The present invention achieves the above-stated objectives by providing an interstage coupling seal comprising a plurality of radially extending members having a first portion which radially seals the coupling, when axially compressed between the coupling's mating sections and having a second portion which snap fits to the interior surface of one of the mating sections. The present invention also provides a method of assembling a gas turbine engine in which the interstage coupling seal is attached to the coupling prior to final assembly.

These and other objects, features and advantages of the present invention, are specifically set forth in, or will become apparent from, the following detailed description of a preferred embodiment of the invention when read in conjunction with the accompanying drawings.

DESCRIPTION OF THE PREFERRED EMBODIMENT

Figure 1:
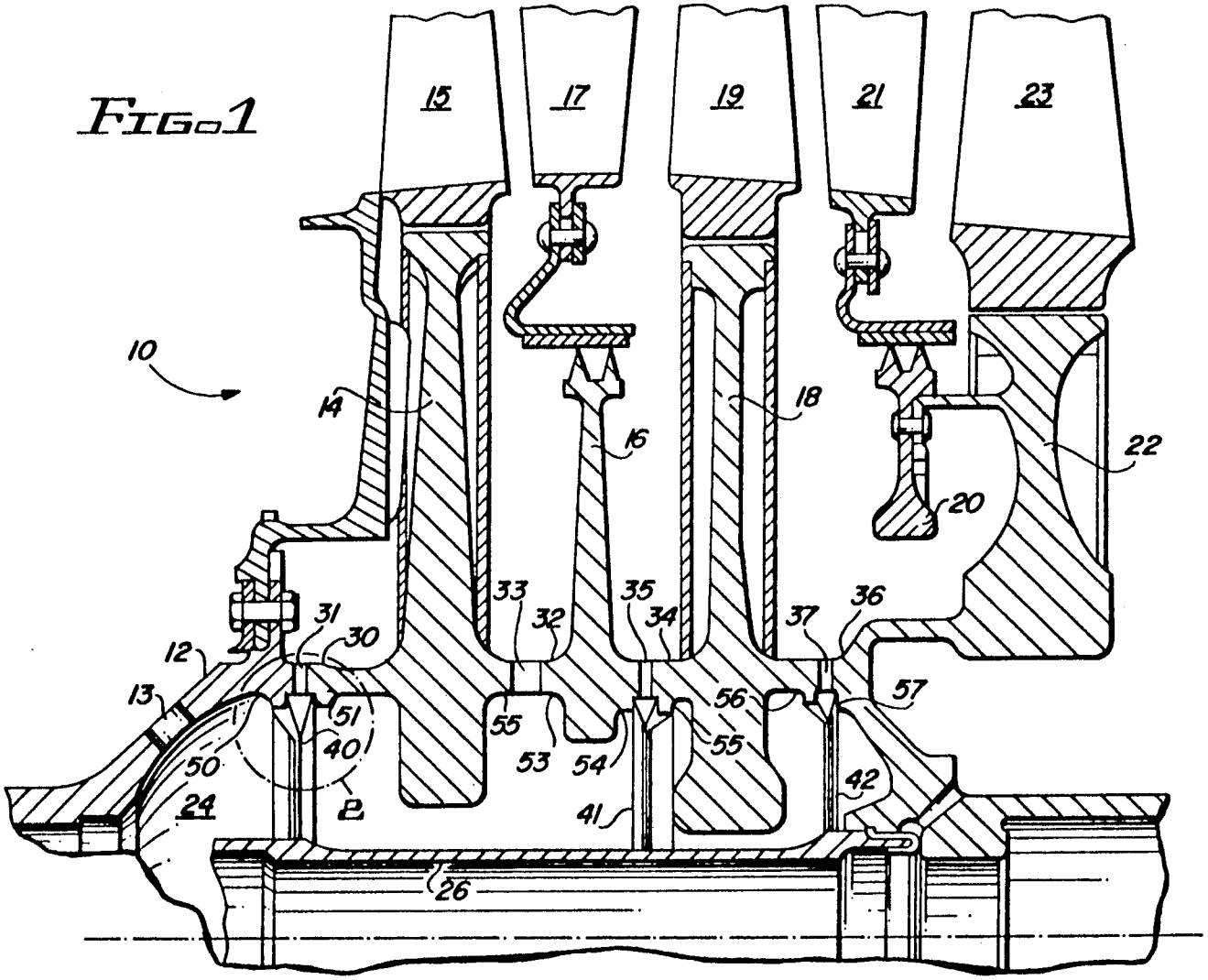
FIG. 1 is a cross sectional of a turbine section of a gas turbine engine having a plurality of the interstage coupling seals contemplated by the present invention.

Referring to the drawings, FIG. 1 shows a portion of a turbine section of a gas turbine engine generally denoted by the reference numeral 10. The turbine section 10 is comprised in flow series arrangement, of a turbine rotor disk shaft portion 12 having cooling air passage 13, a first turbine disk 14 having a rotor blade array 15 extending radially therefrom, a first rotating seal 16, a first array of stator vanes 17 disposed above the rotating seal 16, a second turbine disk 18 having a rotor blade array 19 extending radially therefrom, a second rotating axial seal 20, a second array of stator vanes 21 disposed above the rotating seal 20, and a third turbine disk rotor 22 having a rotor blade array 23 extending radially therefrom. The inner surfaces of the rotating components, 12, 14, 16, 18, and 22 define a bore 24 which extends axially through the center of the turbine section 10. The bore 24 has a tie shaft 26 disposed therein. Four interstage, torque transmitting, couplings 30, 32, 34, and 36 are operably disposed respectively between the shaft 12 and the turbine disk 14, the turbine disk 14 and the rotating seal 16, the axial seal 16 and the turbine disk 18, and the turbine disk 18 and the turbine disk 22. Each of the couplings 30, 32, 34, and 36 has a radial gap 31, 33, 35, and 37 respectively between meshing radial splines circumferentially mounted on opposing mating sections 50 and 51, 52 and 53, 54 and 55, and 56 and 57. Interstage coupling seals 40, 41, and 42 are fixedly mounted to the interior surface of the coupling 30, 34, and 36 respectively. While the preferred embodiment is shown having four rotating components with four couplings and three interstage seals, one skilled in the art would appreciate that the number of rotating components, couplings and seals can be increased or decreased without departing from the scope of the present invention.

Figure 3:
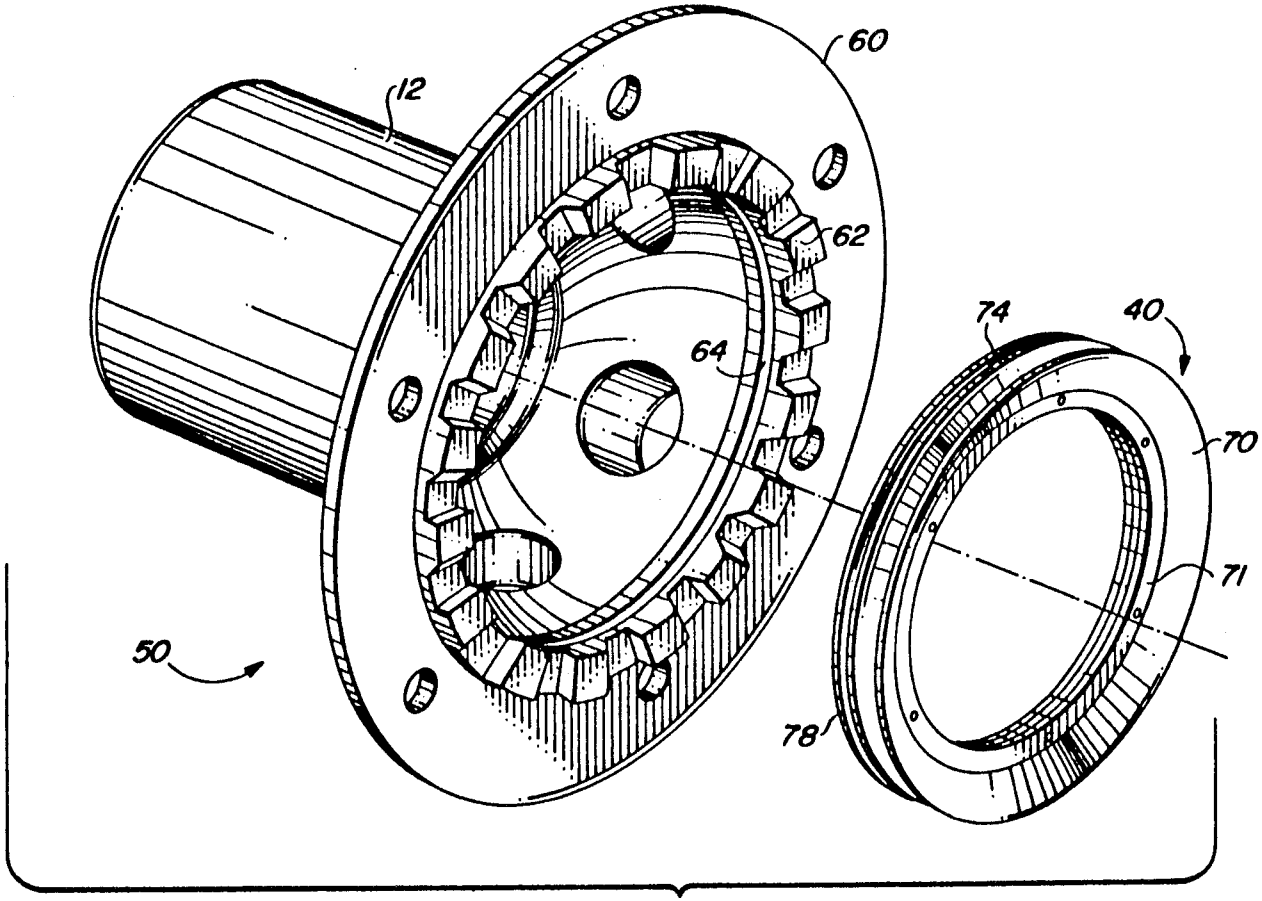
FIG. 3 is an exploded, perspective view of a mating section of a interstage coupling attached to a shaft portion, and the interstage coupling seal of FIG. 1.

The mating sections 50 through 57 are similar in structure so that a description of one mating section would surfeit for all. FIG. 3 shows, for example, the mating section 50 of the coupling 30 mounted on the shaft portion 12. The mating section 50, consists of an annular flange 60 having radial splines 62 circumferentially disposed along its base and extending perpendicularly from the surface of the flange 60. A lip 64, extending radially inward, is circumferentially disposed along the interior surface 66 of the flange 60.

Figure 2A:
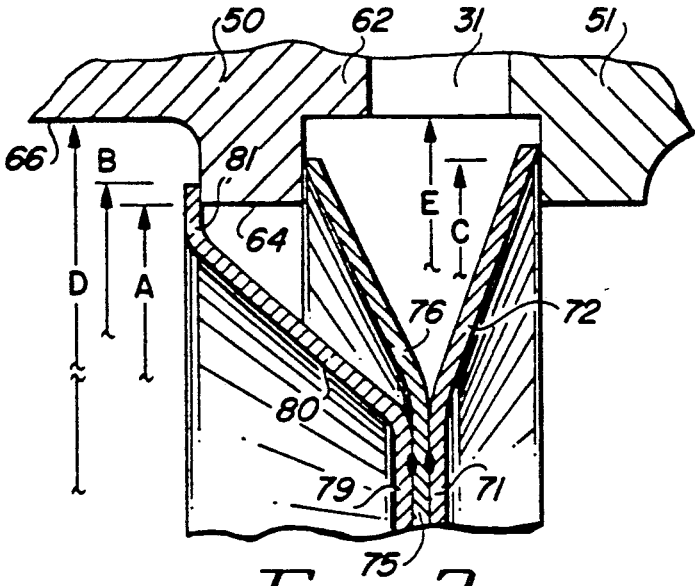
FIG. 2*a* is an enlarged, cross sectional view of a portion, encompassed by circle 2 of FIG. 1 having the interstage coupling seal of FIG. 1.
Figure 2B:
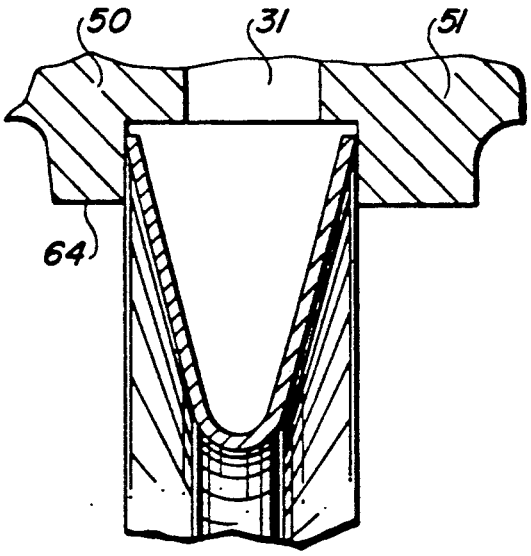
FIG. 2b (PRIOR ART)
FIG. 2*b* is an enlarged, cross sectional view of a portion encompassed by circle, 2 of FIG. 1 having a prior art, ring seal.
Figure 4:
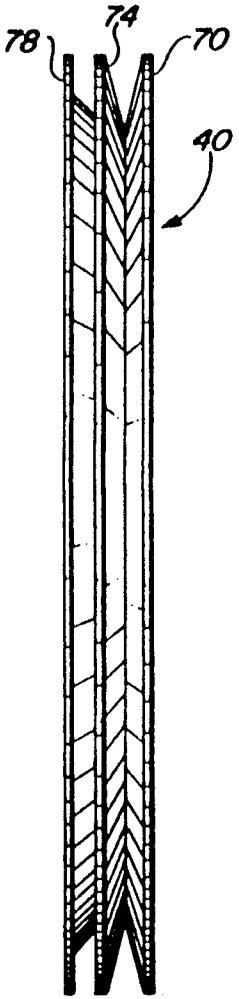
FIG. 4 is a side view of the interstage coupling seal of FIG. 1.

Likewise, the seals 40, 41, and 42 are similarly constructed so the description of one is applicable to all. Thus, for example, the seal 40 is comprised of a first annular plate 70 having an inner flat portion 71 and an outer flat portion 72 extending at an angle therefrom, a second annular plate 74 having an inner flat portion 75 and an outer flat portion 76 extending at an angle therefrom, and a third annular plate 78 having an inner flat portion 79, a middle flat portion 80 extending at an angle therefrom, and an outer flat portion 81 extending from the middle flat portion 80 so that the outer flat portion 81 is disposed approximately parallel with the inner flat portion 79, (see FIG. 2*a*). The inner flat portion 71 is attached to the inner flat portion 75 so that the outer flat portions 72 and 76 form a vee. The inner flat portion 79 is also attached to the inner flat portion 75.

For ease of assembly, in the preferred embodiment, the diameter of the plate 70 is greater than the diameter of the plate 74 which in turn is greater than the diameter of the plate 78. The seal 40 is inserted into the mating section 50 so that the outer flat portions 76 and 81 snap fit onto the lip 64, (see FIG. 2*a*). To assure a proper snap fit, the outside diameter of the outer flat portion 81, dimension B, should be larger than the inside diameter of the lip 64, dimension A. Preferably, dimension B is about from 0.02 inches to about 0.10 inches larger than dimension A, (see FIG. 2*a*). To permit sufficient clearance for assembly, the difference between dimension A and the inside diameter of the surface 66, dimension D, should be greater than the difference between dimensions A and B. Also, the difference between the diameter of the end of outer flat portion 76, dimension C, and the inside diameter of the radial splines 62, dimension E, should be greater than the difference between dimensions A and B. Preferably, the seal 40 is made from Inconel X-750. If required, holes can be placed through the flat portions 72, 76 and 80 to meter the flow of cooling air therethrough.

A method is also disclosed wherein each component of a gas turbine engine is separately preassembled. During the preassembly, the appropriate mating section of an interstage coupling is attached to the appropriate shaft portion and the appropriate interstage coupling seal is inserted into the mating section and snap fit therein. After the preassembly the components are brought together and assembled by stacking each component on top of each other so as to arrive at the appropriate series flow arrangement. As each component is mounted the opposing mating sections of the interstage couplings are meshed forcing the seal into sealing engagement along the underside of the radial splines within the opposing mating sections.

Accordingly, the misassembly errors common with the prior art ring seal are reduced by the interstage coupling seal which can be attached to a mating section of an interstage coupling during preassembly. Another advantage of the interstage coupling seal is that the engine can be disassembled in the field without requiring that the seal be removed.

Various modifications and alterations to the above described interstage coupling seal will be apparent to those skilled in the art. Accordingly, the foregoing detailed description of the preferred embodiment of the invention should be considered exemplary in nature and not as limiting to the scope and spirit of the invention as set forth in the following claims.

What is claimed is:

1. A gas turbine engine comprising a stator assembly and a rotor assembly defining a compressor section, a combustor section and a turbine section arranged in a flow series and having an annular flow path extending axially from said compressor section through said turbine section, said rotor assembly further comprising a plurality of rotor disks disposed axially through said engine and coupled together by a plurality of torque transmitting couplings located between adjacent pairs of said disks, each of said couplings having opposing mating sections, at least one of which has a lip circumferentially disposed along its interior surface, and having coupling means adapted to interengage the two sections, said coupling means having gaps through which cooling air leaks; said couplings having an interstage seal disposed beneath said gaps, said interstage seal disposed beneath said gaps, said interstage seal having radial sealing means for moving into sealing contact beneath said gaps when axially compressed between said opposing mating sections and having means for attaching to said lip.

2. A gas turbine engine comprising a stator assembly and a rotor assembly defining a compressor section, a combustor section and a turbine section arranged in a flow series and having an annular flow path extending axially from said compressor section through said turbine section, said rotor assembly further comprising a plurality of rotor disks disposed axially through said engine and coupled together by a plurality of torque transmitting couplings located between adjacent pairs of said disks, each of said couplings having opposing mating sections, at least one of which has a lip circumferentially disposed along its interior surface, and having coupling means adapted to interengage the two sections, said coupling means having gaps through which cooling air leaks, said couplings having an interstage seal disposed beneath said gaps, said interstage seal comprising a first flat plate extending at an angle from an annular portion, a second flat plate extending at an angle from said annular portion so that said first and second plates form a vee shape; and a third flat plate extending at an angle from said annular portion, and having an end portion extending at an angle from said third flat plate so that said end portion is substantially parallel with said annular portion, said second and third flat plates disposed adjacent to each other so as to snap fit onto said lip.

3. A seal, for reducing air leakage between mating sections of an interstage coupling in a gas turbine engine, wherein one of said mating sections has a lip along its interior surface, comprising:

an annular portion;

a first flat plate extending at an angle from said annular portion;

a second flat plate extending at an angle from said annular portion so that said first and second plates form a vee shape; and a third flat plate extending at an angle from said annular portion, and having an end portion extending at an angle from said third flat plate so that said end portion is substantially parallel with said annular portion, said second and third flat plates disposed adjacent to each other so as to snap fit onto said lip.

4. The seal of claim 3 wherein said first flat plate has a diameter greater than said second flat plate and said second flat plate has a diameter greater than said third flat plate.

5. The seal of claim 4 wherein at least one of said plates has a hole for metering the flow of cooling air therethrough.

* * * * *